US007847693B1

(12) United States Patent
Balardeta et al.

(10) Patent No.: US 7,847,693 B1
(45) **Date of Patent: *Dec. 7, 2010**

(54) CIRCUIT FOR TRANSMITTING A RFID SIGNAL

(75) Inventors: Joseph Balardeta, Encinitas, CA (US); Scott Denton, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/857,444

(22) Filed: Aug. 16, 2010

Related U.S. Application Data

(63) Continuation of application No. 12/796,384, filed on Jun. 8, 2010, now Pat. No. 7,804,404.

(51) Int. Cl.
*G08B 13/14* (2006.01)

(52) U.S. Cl. ..... 340/568.6; 340/539.13; 473/151

(58) Field of Classification Search ..... 340/568.6, 340/539.13; 473/151
See application file for complete search history.

(56) References Cited

U.S. PATENT DOCUMENTS

| | | | |
|---|---|---|---|
| 2008/0001720 | A1 | 1/2008 | Tuttle |
| 2008/0147211 | A1 | 6/2008 | Teller |
| 2010/0045443 | A1 | 2/2010 | Steeves |

*Primary Examiner*—George Bugg
*Assistant Examiner*—Frederick Ott
(74) *Attorney, Agent, or Firm*—Michael A. Catania; Sonia Lari

(57) ABSTRACT

A circuit for conserving power for a shot tracking device attached to a grip of a golf club is disclosed. The circuit comprises a battery, a resistor in electrical communication with the battery, a capacitor in electrical communication with the resistor, a load switch in electrical communication with the capacitor, a microprocessor in electrical communication with the load switch, and the microprocessor comprising a radiofrequency transceiver.

1 Claim, 8 Drawing Sheets

CIRCUIT FOR TRANSMITTING A RFID SIGNAL

CROSS REFERENCES TO RELATED APPLICATIONS

The present application is a continuation application of U.S. patent application Ser. No. 12/796,384, filed on Jun. 8, 2010.

STATEMENT REGARDING FEDERALLY SPONSORED RESEARCH OR DEVELOPMENT

Not Applicable

BACKGROUND OF THE INVENTION

1. Field of the Invention

The present invention relates to a circuit for transmitting a RFID signal while conserving battery power. More specifically, the present invention relates to a system for transmitting a signal while conserving battery power by utilizing a resistor in series with a power source prior to a capacitor, allowing that capacitor to be charged at a controlled rate and further comprising an automatic switch, allowing power to flow only when desired.

2. Description of the Related Art

Reducing power consumption in most portable electronic devices is important but it is especially important in electronic devices that are not rechargeable or have replaceable batteries, and are operated continuously, that is the device is always active in some mode. Such devices are essentially consumables since once the battery power is exhausted the exhausted the device is no longer useful.

An obvious solution would be to, if possible, program the electronic device with sufficient intelligence to activate and deactivate as needed. However, many modern electronic devices require more sophistication than simple activation and deactivation, and the act of activating a device after deactivation may only add to the power depletion. Further, many modern electronic devices include various components that have varying power requirements in order to function properly in continuous operation.

The prior art is lacking in a circuit to conserve battery power while sensing for motion and then transmitting the information pertaining to the sensed motion using a radiofrequency component.

BRIEF SUMMARY OF THE INVENTION

The present invention is novel in that the circuitry comprises components positioned such that a RFID signal may be transmitted while battery power is conserved.

One aspect of the present invention is a circuit for transmitting a RFD signal while conserving battery power for a circuit in continuous operation. The present invention comprises a circuit for a shot tracking device for attachment to a grip of a golf club. The shot tracking device comprises a housing, a battery disposed within the housing and a circuit board disposed within the housing. In one embodiment, the housing may comprise a main body and a projection body extending downward from the main body. The circuit board has a first side and a second side. A sensor is disposed on the circuit board and a plurality of board components are disposed on the first side and the second side of the side of the circuit board. The plurality of board components includes a battery having no more than 75 milliamp-hours of capacity, a resistor in electrical communication with the battery, wherein the resistor controls the rate at which a capacitor is charged from the battery. The circuit further comprises a capacitor in electrical communication with the resistor, wherein the capacitor is a one micro-Farad capacitor and a load switch in electrical communication with the capacitor, wherein the load switch is maintained in an open state until an impact transitions the load switch to a closed state. The circuit further comprises a microprocessor in electrical communication with the load switch, wherein when the load switch is in a closed state, current drawn from the capacitor is allowed to flow to the microprocessor; and a radiofrequency component in electrical communication with the microprocessor, wherein when the load switch is in a closed state a signal is transmitted from the radiofrequency component and a confirmation signal is received at the radiofrequency component. The radiofrequency component operates at 2.4 giga-Hertz, wherein a peak current of transmission of the signal which is limited to 2 milliamps.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
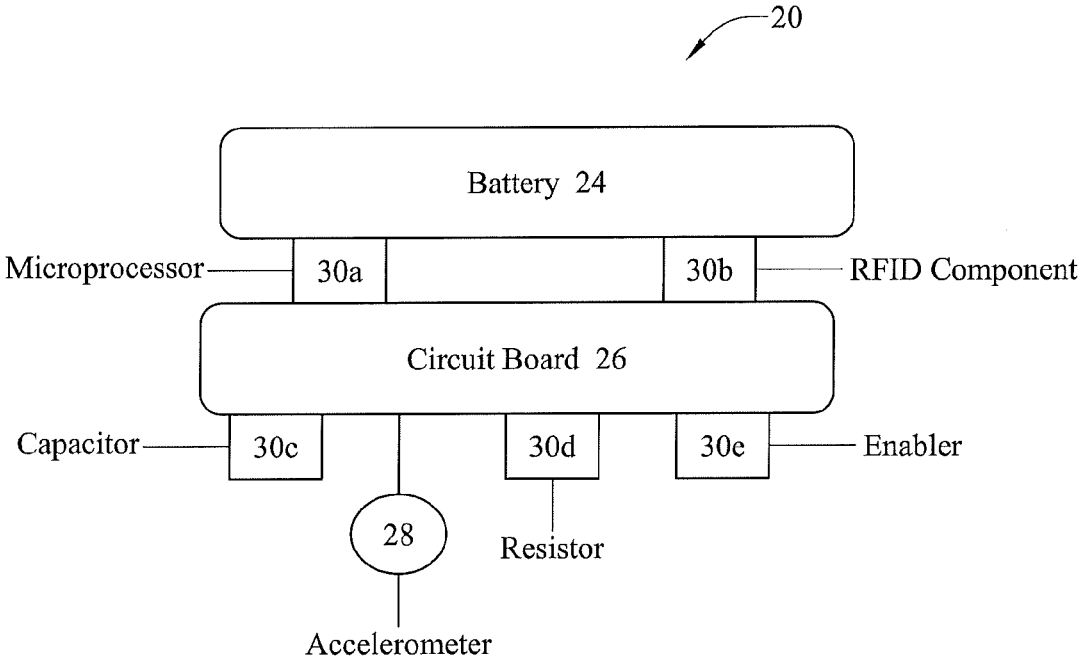
FIG. 1 is an interior view of a device with a power-saving circuit having a radiofrequency transmission component.

The components of the system which can be attached to a golf club 50 are illustrated in FIG. 1. The components are preferably held within a housing 22 of the device 20. The interior components comprise a battery 24, a circuit board 26 optionally having an accelerometer 28, a microprocessor 30*a*, a RFID component 30*b*, a capacitor 30*c*, a resistor 30*d*, a load switch 53 and an enabler 30*e*.

Figure 2:
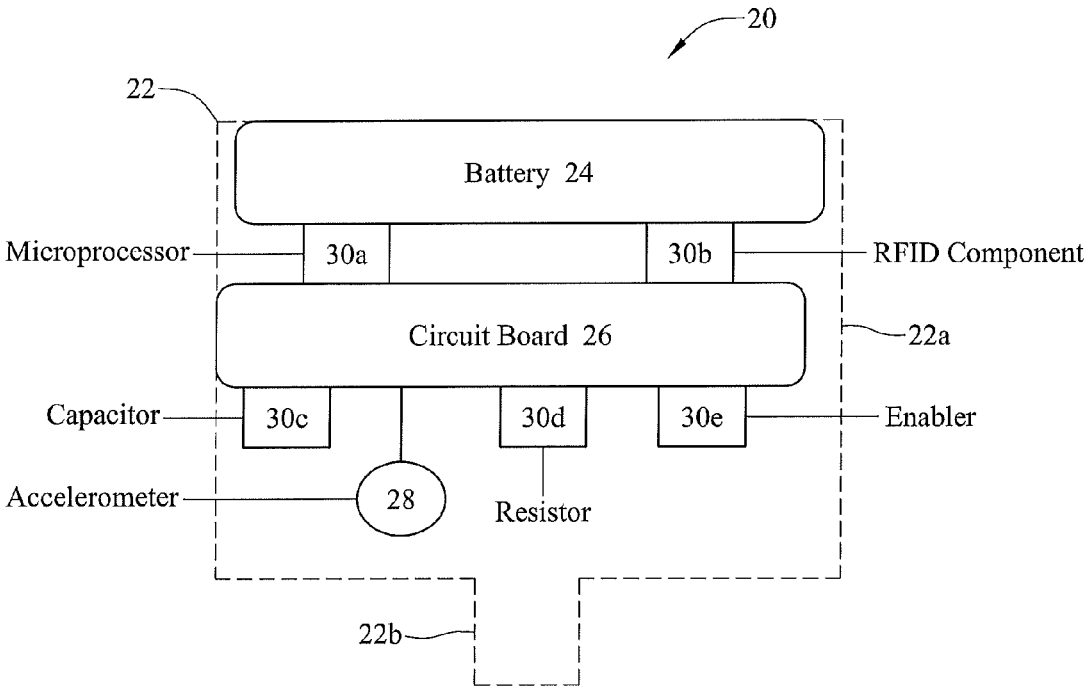
FIG. 2 is an interior view of a device with a power-saving circuit having a radiofrequency transmission component including the main body and projection body extending downward.

FIG. 2 illustrates the device 20 including the main body 22*a* and a projection 22*b*. The projection 22*b* preferably is placed within an aperture of a grip (not shown) of a golf club 50. The projection body 22*b* preferably has a length that ranges from 1 millimeter ("mm") to 5 mm. The main body 22*a* preferably has a diameter, D, that ranges from 20 mm to 25 mm.

Figure 3:
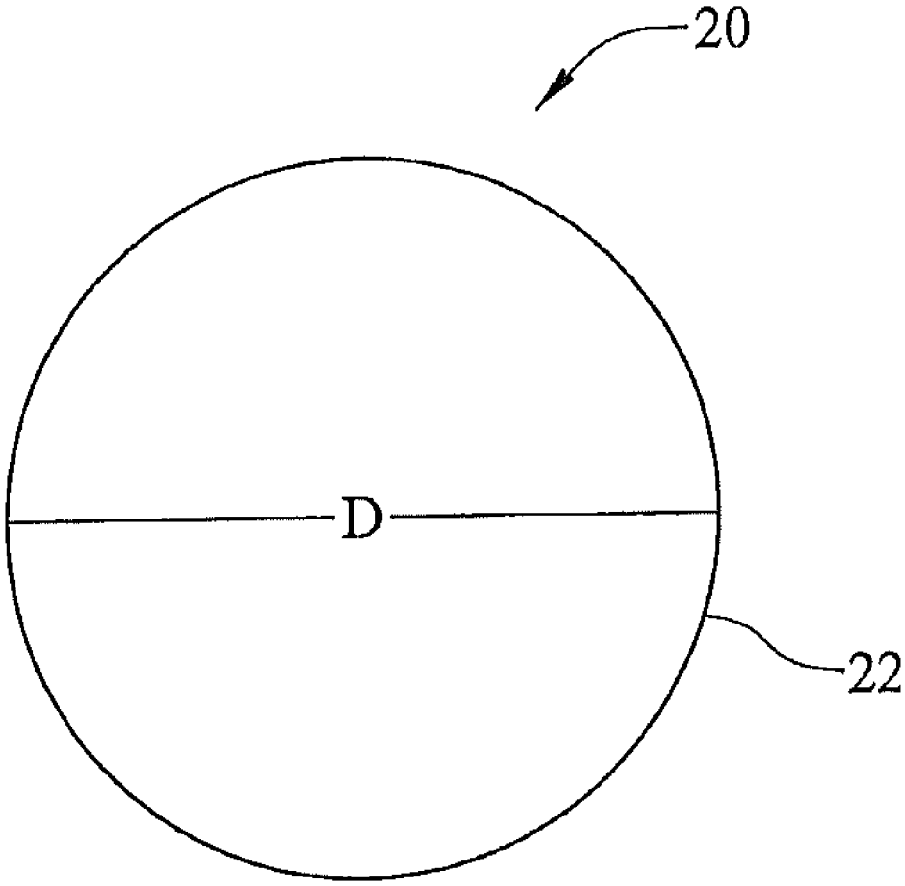
FIG. 3 is a perspective view of the shot tracking device illustrating the diameter.

FIG. 3 shows the housing 22 of the shot tracking device 20 and illustrates the diameter of the housing 22. Preferably the housing 22 is composed of a rubberized material formed around the battery 24 and the circuit board 26. In an alternative embodiment, the housing 22 is composed of an epoxy material formed around the battery 24 and the circuit board 26.

Figure 4:
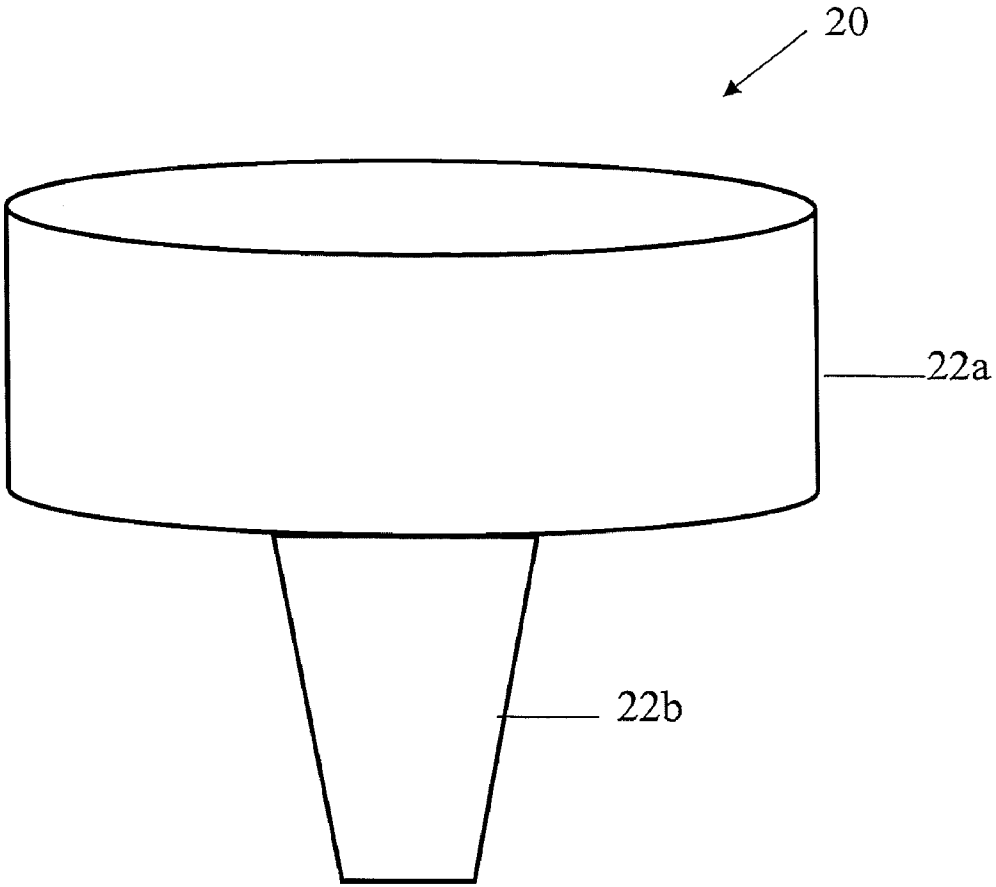
FIG. 4 is a perspective view of the device of the present invention including the main body and projection body extending downward.

FIG. 4 is a perspective view of the shot tracking device 20 of the present invention including the main body and projection body extending downward.

Figure 5:
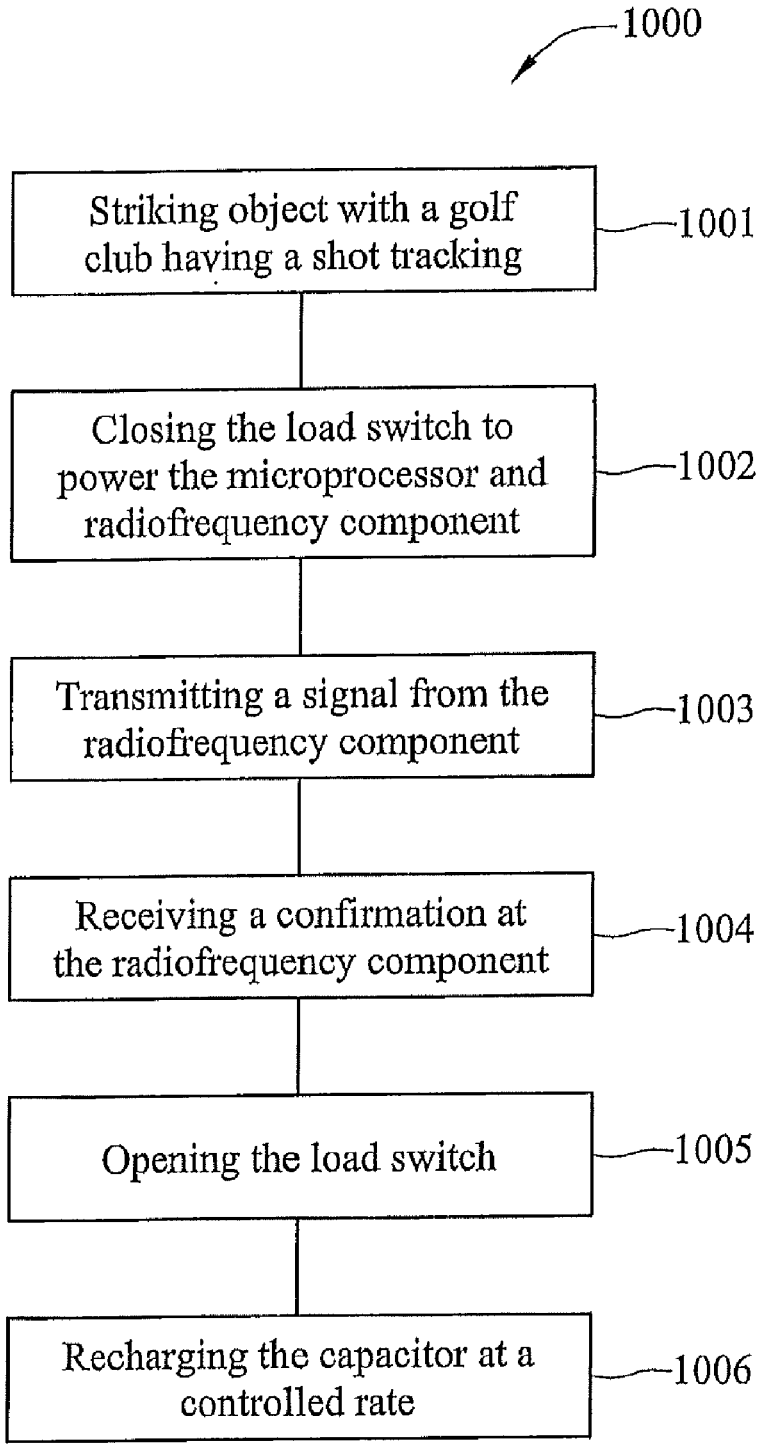
FIG. 5 is a flow chart of a method of conserving power for the shot tracking device.

FIG. 5 is a flow chart of a method 1000 for conserving power for the shot tracking device 20. At block 1001, an object is struck using the golf club 50 having the shot tracking device 20. At block 1002, the load switch 53 is closed to power the microprocessor 30*a* and the RFID component 30*b*. At block 1003, a signal is transmitted from the RFID component 30*b*. At block 1004, a confirmation signal is received at the RFID component 30*b*. At block 1005, the load switch 53 is opened and at block 1006, the capacitor 30*c* is recharged at a controlled rate.

Figure 6:
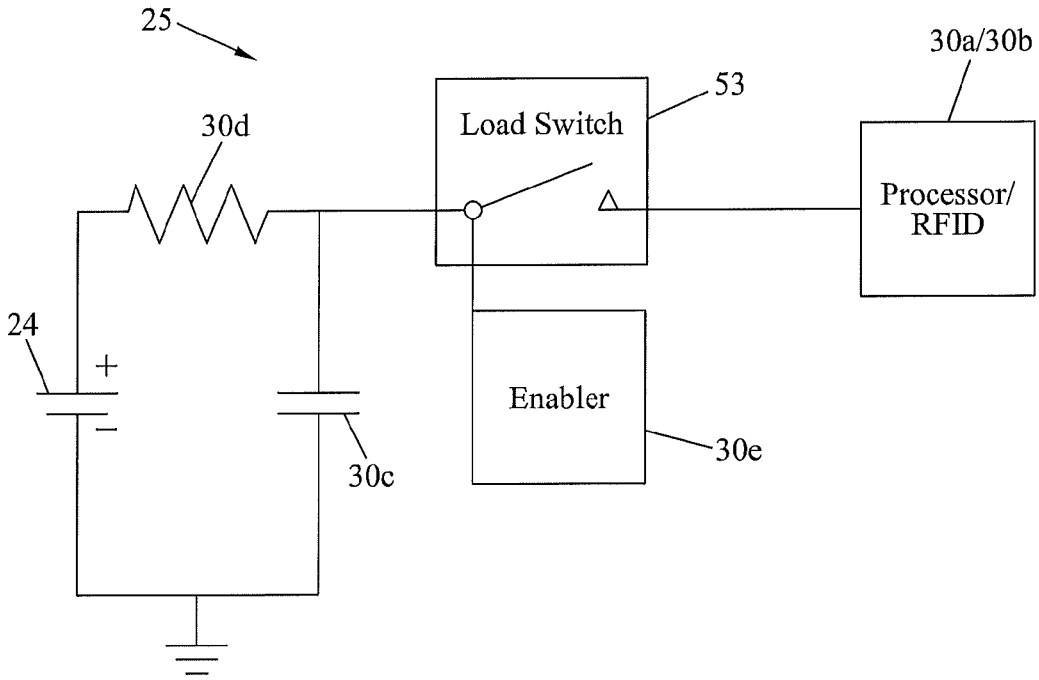
FIG. 6 is a block diagram of components of a system for shot tracking with the switch in an open state.

FIG. 6 illustrates the components of the circuit diagram 25 located within the device 20 of the present invention which is located within a golf club 50 prior to impact of the golf club 50 with a golf ball. A circuit diagram 25 of a preferred embodiment of the present invention is shown. The circuit 25 includes a battery 24, a capacitor 30*c*, a resistor 30*d*, optionally an accelerometer 28, a microprocessor 30*a* and an RFID component 30*b*. The battery 24 is preferably a battery having no more than 75 milliamps of power. In a device 20, under continuous operation, the battery 24 should provide power for an estimated five years of normal use of the device 20. The accelerometer 28, if included, is preferably a LIS3DH ultra low-power high-performance 3-axes nano accelerometer from ST Microelectronics, which has a 32 first in first out (FIFO) buffer. The RFID component is preferably an RF24L01 single chip 2.4 giga Hertz transceiver from Nordic Semiconductor.

Figure 7:
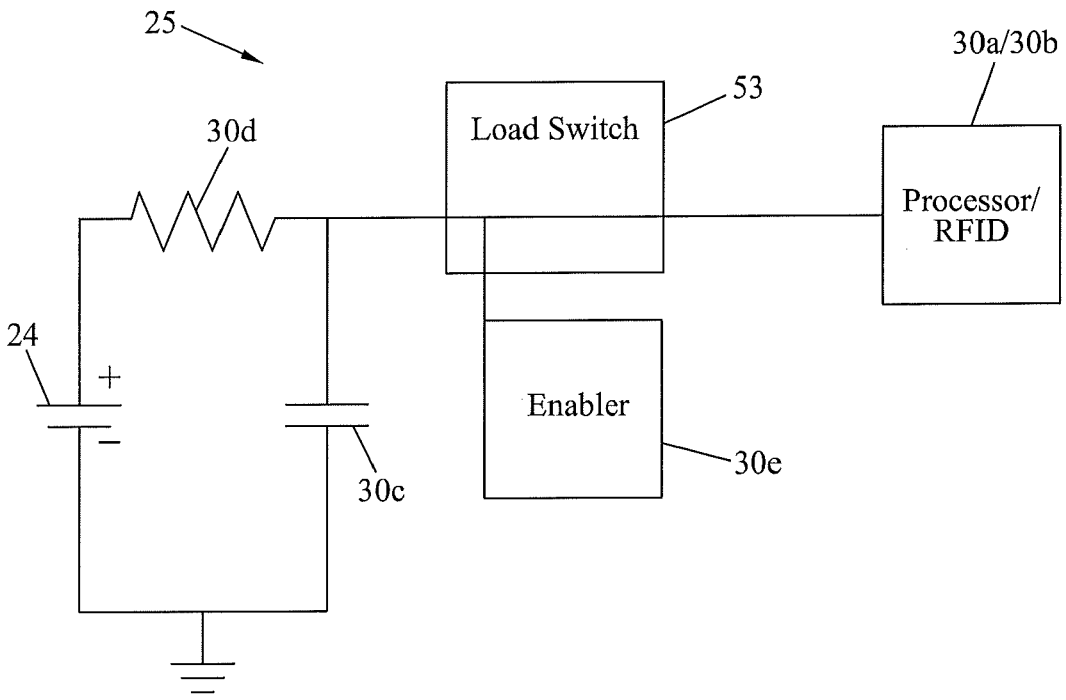
FIG. 7 is a block diagram of components of a system for shot tracking with the switch in a closed state.

FIG. 7 illustrates components of the system located within a golf club 50 subsequent to impact of a golf club 50 with a golf ball.

The circuit 25 of the present invention claims novelty in the precise location of each component. The location of the resistor 30(*d*) directly after the power source 24 and prior to the capacitor 30(*c*) allows for the capacitor 30(*c*) to be charged at a controlled rate. The presence of the automatic load switch 53 between the power source 24 and the RFID component 30(*b*) allows for the conservation for battery power 24 as the load switch 53 is only closed, enabling the circuit 25 to activate and consume power, when there has been impact of the golf club 50 and transmission of the RFID signal 62 is desired. With no impact, the switch 53 is open, thus deactivating the circuit 25 and allowing the power to be conserved.

Figure 8:
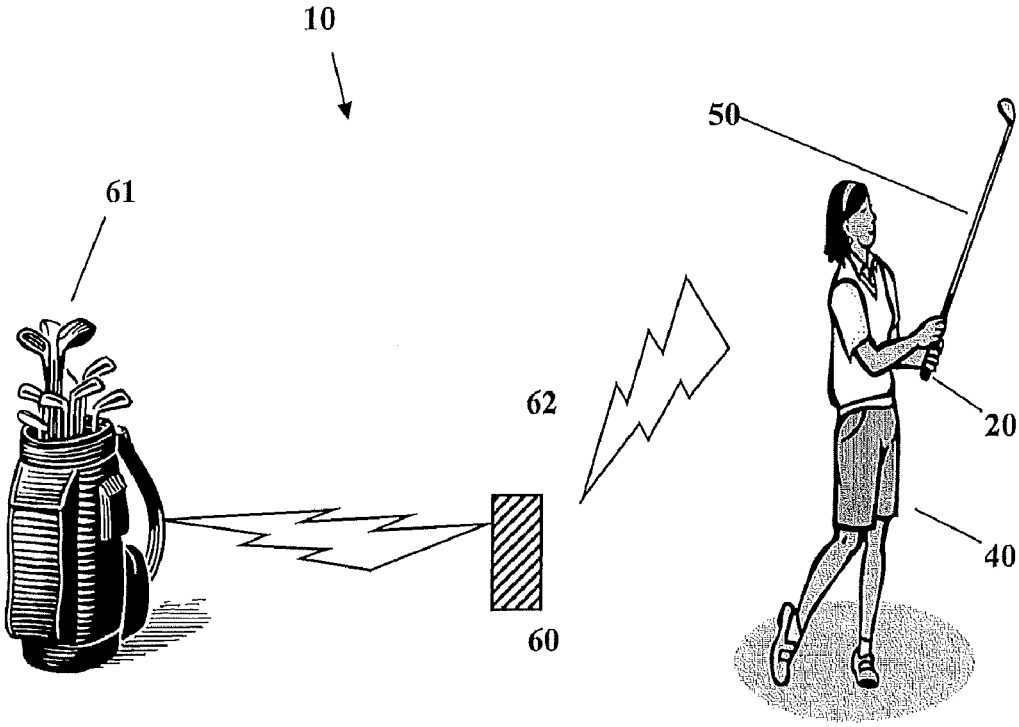
FIG. 8 is an illustration of a golfer using a golf club utilizing a device with a power-saving circuit having a radiofrequency transmission component.

A system 10 for shot tracking is illustrated in FIG. 8. A golfer 40 strikes a golf ball with a golf club 50. The golf club 50 includes a device 20 preferably positioned within the within the grip. The device 20 includes a circuit 25 for transmitting a RFID signal while conserving the battery power of the device 20. The RFID signal 62 is preferably transmitted to a receiver 60 attached to a golf bag 61.

The receiver 60 is preferably a GPS device such as disclosed in Balardeta et al., U.S. Patent Publication Number 20090075761 for a Golf GPS Device And System, which is hereby incorporated by reference in its entirety. Alternatively, the receiver is a personal digital assistant (PDA), "smart phone", mobile phone, or other similar device. However, those skilled in the pertinent art will recognize that the receiver may be any type of receiver capable of receiving and storing signals from the device 20.

The circuit 25 of the present invention for conserving power for a shot tracking device 20 attached to a grip of a golf club 50 comprises a battery 24 having no more than 75 milliamp-hours of capacity. The circuit 25 further comprises a resistor 30(*d*) in electrical communication with the battery 24, wherein the resistor 30(*d*) controls the rate at which a capacitor 30(*c*) is charged from the battery 24. The circuit 25 comprises a capacitor 30(*c*) in electrical communication with the resistor 30(*d*), wherein the capacitor 30(*c*) is a one micro-Farad capacitor. The circuit 25 also comprises a load switch 53 in electrical communication with the capacitor 30(*c*), the load switch 53 maintained in an open state until an impact transitions the load switch 53 to a closed state. The circuit 25 further comprises a microprocessor 30(*a*) in electrical communication with the load switch 53, wherein when the load switch 53 is in a closed state, current drawn from the capacitor 30(*c*) is allowed to flow to the microprocessor 30(*a*). The microprocessor 30(*a*) also comprises a radiofrequency transceiver 30(*b*), wherein when the load switch 53 is in a a closed state, a signal 62 is transmitted from the radiofrequency transceiver 30(*b*) and a confirmation signal 62 is received at the radiofrequency transceiver 30(*b*). The radiofrequency transceiver 30(*b*) operates at 2.4 giga-Hertz and a peak current of transmission of the signal is limited to 2 milliamps.

The present invention further comprises a method for conserving power for a shot tracking device 20 attached to the grip of a golf club 50. The method comprises striking an object with the golf club 50 having a shot tracking device 20. The shot tracking device comprises 20 a housing 22, a battery 24 in electrical communication with a resistor 30(*d*) which is in electrical communication with a capacitor 30(*c*) and a load switch 53. The load switch 53 is in electrical communication with an enabler 30(*e*) and a microprocessor 30(*a*). The microprocessor 30(*a*) is in electrical communication with a radiofrequency component 30(*b*).

When the load switch 53 is closed, power 52 flows to the microprocessor 30(*a*) and the radiofrequency component 30(*b*). The power 52 is drawn from the capacitor 30(*c*). A signal 62 is transmitted from the radiofrequency component 30(*b*) and a confirmation signal 62 is received at the radiofrequency component 30(*b*). The load switch 53 is opened and the capacitor 30(*c*) is recharged at a controlled rate.

A preferred microprocessor 30(*a*) is a CYRF69103 provided by Cypress Perform. This microprocessor is a complete Radio System-on-Chip device, providing a complete RF system solution with a single device. The microprocessor contains a 2.4 GHz Mbps GFSK radio transceiver, packet data buffering, packet framer, DSSS baseband controller, Received Signal Strength Indication (RSSI), and SPI interface for date transfer and device configuration.

A preferred load switch 53 is an AP2280 provided by Diodes Inc., which is a single channel slew rate controlled load switch. The AP2280 load switch has a quiescent supply current that is typically only 0.004 micro-amps, making it ideal for battery powered distribution system where the power consumption is a concern.

In an alternative embodiment of the present invention, the shot tracking device 20 comprises a housing 22 with a main body 22(*a*) and a projection body 22(*b*) extending downward from the main body 22(*a*). A battery 24 is disposed within the housing 22 and a circuit board 26 is disposed within the housing 22 and below the battery 24. The circuit board 26 is double sided, and has a load switch 53 disposed on the second side. A plurality of components 30, including a microprocessor 30(*a*), an RFID component 30(*b*), a capacitor 30(*c*), a resistor 30(*d*), and an enabler 30(*e*), are disposed on both the first and second side of the circuit board 26. The shot tracking device 20 transmits a signal 62 when the golf club 50 strikes a golf ball, the signal 62 comprising an identification of the golf club 50.

The plurality of board components 30 includes a microprocessor 30(*a*). The microprocessor 30(*a*) is configured to deactivate transmissions of the signal 62 when a threshold number of signals are transmitted by the shot tracking device 20 and a receipt signal is not received by the shot tracking device 20. The threshold number of signals ranges from 5 to 50. The threshold number of signals preferably ranges from 10 to 40, more preferably from 15 to 30 and is most preferred to be 20. Each signal transmitted consumes approximately 2 milliamps of power. The signal comprises a frequency of approximately 2.4 GHz.

Preferably, the housing 22 is a rubberized material formed around the battery 24, the circuit board 26, the optional accelerometer 28 and the plurality of chips. Alternatively, the housing 22 is an epoxy material formed around the battery 24, the circuit board 26, the accelerometer 28 and the plurality of board components 30.

The golf club 50 is any golf club of a set, and preferably every golf club in a golfer's golf bag 61 has a device 20 attached thereto. Further, a resolution of the accelerometer 28 is set to each particular golf club 50. For example, a putter requires a higher resolution than a driver since the movement of the putter during a golf swing is much less than the movement of a driver during a golf swing. In this manner, the device 20 for a putter has an accelerometer 28 set at a high resolution.

The following patents disclose various golf clubs that may be used with the device of the present invention. Gibbs, et al., U.S. Pat. No. 7,163,468 is hereby incorporated by reference in its entirety. Galloway, et al., U.S. Pat. No. 7,163,470 is hereby incorporated by reference in its entirety. Williams, et al., U.S. Pat. No. 7,166,038 is hereby incorporated by reference in its entirety. Desmukh U.S. Pat. No. 7,214,143 is hereby incorporated by reference in its entirety. Murphy, et al., U.S. Pat. No. 7,252,600 is hereby incorporated by reference in its entirety. Gibbs, et al., U.S. Pat. No. 7,258,626 is hereby incorporated by reference in its entirety. Galloway, et al., U.S. Pat. No. 7,258,631 is hereby incorporated by reference in its entirety. Evans, et al., U.S. Pat. No. 7,273,419 is hereby incorporated by reference in its entirety. Hocknell, et al., U.S. Pat. No. 7,413,250 is hereby incorporated by reference in its entirety.

The measurements may be inputted into an impact code such as the rigid body code disclosed in U.S. Pat. No. 6,821,209, entitled Method for Predicting a Golfer's Ball Striking Performance, which is hereby incorporated by reference in its entirety.

The swing properties are preferably determined using an acquisition system such as disclosed in U.S. Pat. No. 6,431,990, entitled System and Method for Measuring a Golfer's Ball Striking Parameters, assigned to Callaway Golf Company, the assignee of the present application, and hereby incorporated by reference in its entirety. However, those skilled in the pertinent art will recognize that other acquisition systems may be used to determine the swing properties.

Other methods that are useful in obtaining a golfer's swing characteristics are disclosed in U.S. Pat. No. 6,638,175, for a Diagnostic Golf Club System, U.S. Pat. No. 6,402,634, for an Instrumented Golf Club System And Method Of Use, and U.S. Pat. No. 6,224,493, for an Instrumented Golf Club System And Method Of Use, all of which are assigned to Callaway Golf Company, the assignee of the present application, and all of which are hereby incorporated by reference in their entireties.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by unlimited by the foregoing except as may appear in the following appended claims. Therefore, the embodiments of the invention in which an exclusive property or privilege is claimed are defined in the following appended claims.

We claim as our invention the following:

1. A circuit for conserving power for a shot tracking device attached to a grip of a golf club, the circuit comprising:

a battery having no more than 75 milliamp-hours of capacity;

a resistor in electrical communication with the battery, wherein the resistor controls a rate at which a capacitor is charged from the battery;

the capacitor in electrical communication with the resistor, wherein the capacitor is a one micro-Farad capacitor;

a load switch in electrical communication with the capacitor, the load switch maintained in an open state until an impact transitions the load switch to a closed state;

a microprocessor in electrical communication with the load switch, wherein when the load switch is in the closed state, current drawn from the capacitor is allowed to flow to the microprocessor;

the microprocessor comprising a radiofrequency transceiver, wherein when the load switch is in the closed state a signal is transmitted from the radiofrequency transceiver and a confirmation signal is received at the radiofrequency transceiver, wherein the radiofrequency transceiver operates at 2.4 giga-Hertz, wherein a peak current of transmission of the signal which is limited to 2 milliamps;

and the load switch, with no impact, transitions to an open state, thus deactivating the microprocessor and allowing the power to be conserved;

the circuit of the shot tracking device attached to the grip of the golf club.

* * * * *